US007451628B1

(12) United States Patent
Kim

(10) Patent No.: US 7,451,628 B1
(45) Date of Patent: Nov. 18, 2008

(54) APPARATUS FOR OPENING AND CLOSING GLOVEBOX FOR AUTOMOBILE

(75) Inventor: Hyun Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/942,205

(22) Filed: Nov. 19, 2007

(30) Foreign Application Priority Data

May 23, 2007 (KR) ..... 10-2007-0050241

(51) Int. Cl.
*B65D 55/14* (2006.01)

(52) U.S. Cl. ..... 70/159; 70/162; 70/190; 70/208; 292/142; 292/254; 292/DIG. 37; 296/24.34; 296/37.8; 296/37.12

(58) Field of Classification Search ..... 70/159–162, 70/190, 191, 208; 292/142, 254, DIG. 37; 296/24.34, 37.8, 37.12
See application file for complete search history.

(56) References Cited

U.S. PATENT DOCUMENTS 1,086,462 A * 2/1914 Randa ..... 292/172
1,089,324 A * 3/1914 Chesley ..... 292/213
1,769,288 A * 7/1930 Godfried et al. ..... 292/254
2,431,105 A * 11/1947 Brinson ..... 292/172
3,871,198 A * 3/1975 Miller ..... 70/489
4,163,375 A * 8/1979 Fujitaki ..... 70/134
4,177,656 A * 12/1979 Davis ..... 70/84
4,271,691 A * 6/1981 Logan ..... 70/422
4,826,224 A * 5/1989 Lee ..... 292/254
4,902,052 A * 2/1990 Laine ..... 292/144
5,484,178 A * 1/1996 Sandhu et al. ..... 292/173
6,116,662 A * 9/2000 Johnson ..... 292/142
6,318,134 B1 * 11/2001 Mossberg et al. ..... 70/63
7,156,440 B2 * 1/2007 Katagiri ..... 296/37.12
7,188,871 B2 * 3/2007 Nemoto et al. ..... 292/170

* cited by examiner

*Primary Examiner*—Lloyd A Gall
(74) *Attorney, Agent, or Firm*—Morgan Lewis & Bockius LLP

(57) ABSTRACT

An apparatus for opening and closing a door of a glovebox mounted in an instrument panel. The apparatus includes a latch mounted to either the door or the instrument panel, a push button mounted to the other one of the door or the instrument panel, a rack bar connected to the push button and extending inward, a pinion engaged with the rack bar, and a link having a rack gear engaged with the pinion. The link is movable to lock and unlock the latch.

5 Claims, 5 Drawing Sheets

APPARATUS FOR OPENING AND CLOSING GLOVEBOX FOR AUTOMOBILE

CROSS REFERENCE TO RELATED APPLICATIONS

This application claims priority to Korean Application No. 10-2007-0050241, filed on May 23, 2007, the disclosure of which is incorporated herein by reference.

BACKGROUND OF THE INVENTION

1. Field of the Invention

The present invention relates generally to an apparatus for opening and closing an automobile glovebox, and more particularly to such an apparatus including a latch, unlocked through a rack and pinion mechanism.

2. Description of the Related Art

A variety of opening and closing units have been provided to automotive gloveboxes. However, many of these opening and closing units have complicated structures, or are not effective.

SUMMARY OF THE INVENTION

An apparatus for opening and closing a door of a glovebox mounted in an instrument panel. The apparatus includes a latch mounted to either the door or the instrument panel, a push button mounted to the other one of the door or the instrument panel, a rack bar connected to the push button and extending inward, a pinion engaged with the rack bar, and a link having a rack gear engaged with the pinion. The link is movable to lock and unlock the latch.

A locking unit, for constraining operation of the push button, may further be provided on either the door or the instrument panel. The locking unit may include a locking plug, operable by a key, and a locking rod attached to the link. When the locking plug is in a lock position, the locking plug impedes movement of the locking rod such that the link cannot unlock the latch. One end of the locking plug may have a semi-circular cross-section, and the locking rod may face the semi-circular end of the locking plug.

The rack bar may be biased outward. The rack bar and the link may be perpendicular to each other.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF PREFERRED EMBODIMENTS

Figure 1:
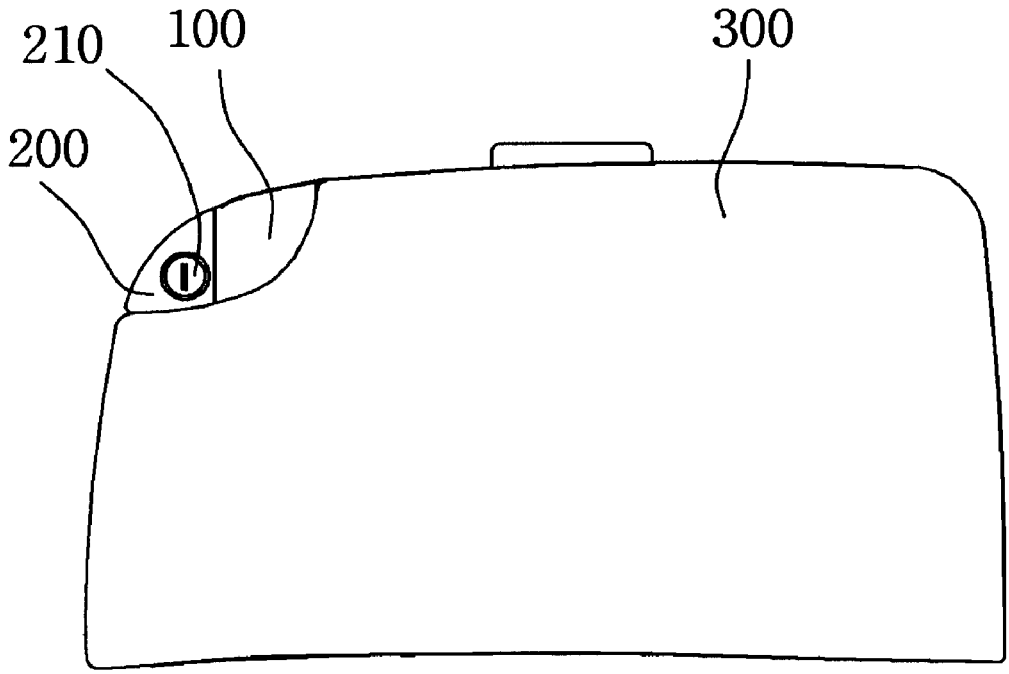
FIG. 1 is a front view of a glovebox according to embodiments of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
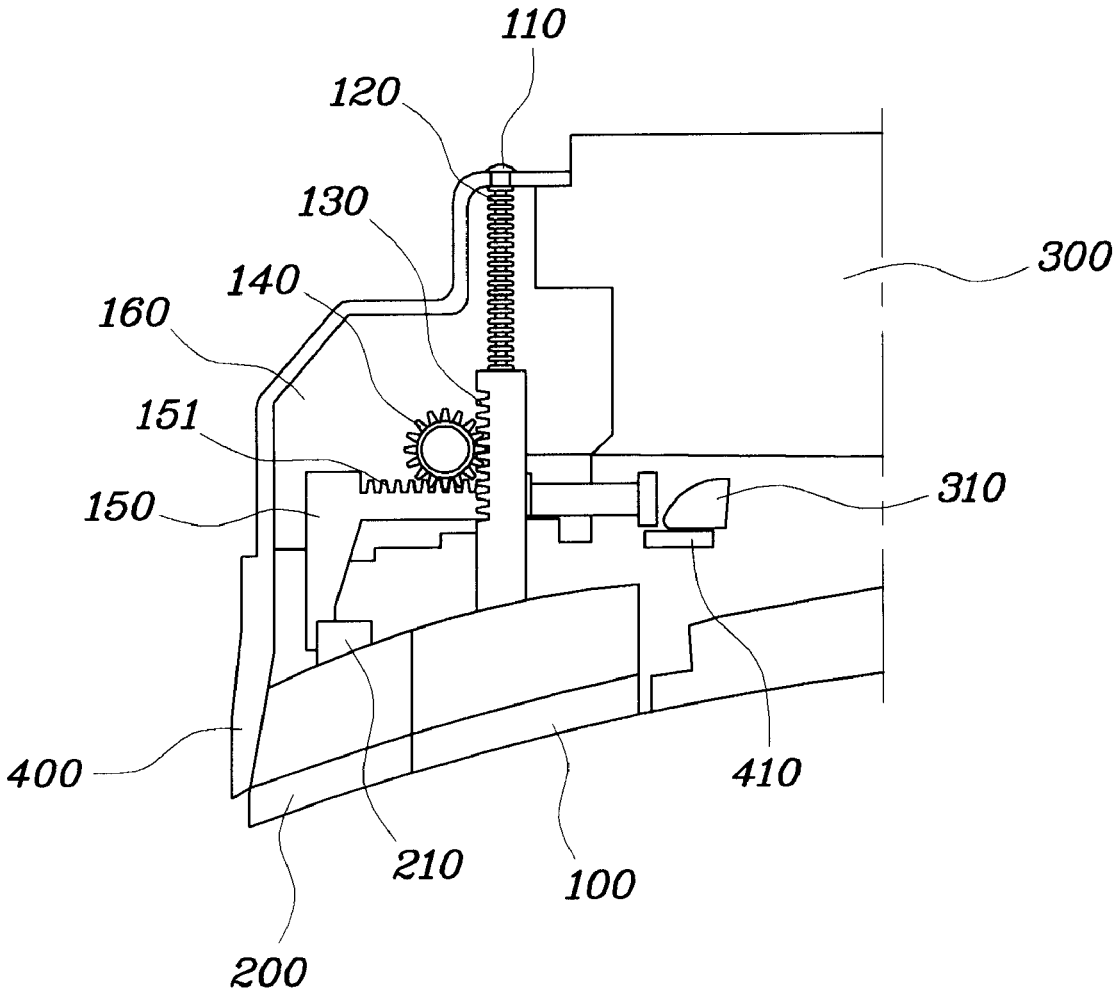
FIG. 2 is a plan view of an exemplary apparatus for opening and closing the glovebox of FIG. 1.
Figure 3:
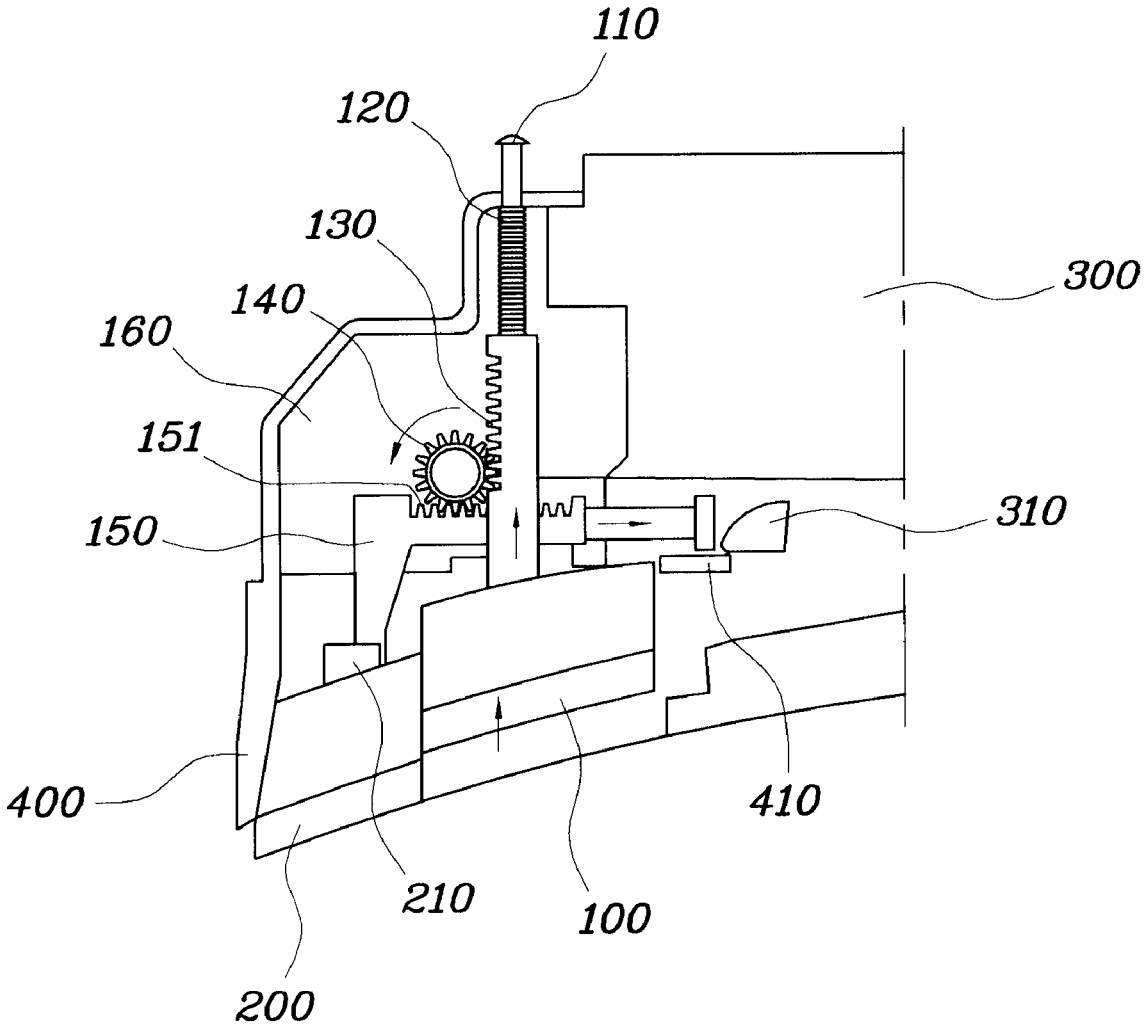
FIG. 3 is a plan view of the operation of the apparatus of FIG. 2.

Referring to FIGS. 1, 2 and 3, embodiments of the present invention provide an automobile glovebox 300, mounted on an automotive instrument panel 400. The glovebox 300 is provided with a latch 310 that is locked to and unlocked from the instrument panel 400. The latch 310 can be unlocked using a push button 100.

More specifically, the apparatus for opening and closing the glovebox includes a rack bar 130; the push button 100 installed on the instrument panel 400; a pinion 140 engaged with the rack bar 130; and a link 150 that is engaged with the pinion 140 and cooperates with the push button 100 to unlock the latch 310 when the push button 100 is pushed.

The push button 100 is exposed outside the instrument panel 400, and is attached to the rack bar 130, which extends inwards, behind the instrument panel 400.

The rack bar 130 is engaged with the pinion 140, and is provided with an extension bar 110, which extends inwards. The extension bar 110 is biased outward by a spring 120. Accordingly, when the user pushes and then releases the push button 100, the spring 120, compressed by the push button 100, is released, and thereby the push button 100 also returns to its original position.

The pinion 140 converts the linear motion of the rack bar 130 into rotational motion. The pinion 140 is mounted to a support bracket 160 that is fixedly installed in the instrument panel 400. The pinion 140 is engaged with the rack bar 130 at an upper portion thereof, and with the link 150, which will be described below, at a lower portion thereof.

The link 150 releases the door of the glovebox 300 from the instrument panel 400 when the push button 100 is pushed. To this end, the link 150 is provided with a rack gear 151 (FIGS. 2-3) engaged with the pinion 140 on one side thereof, and extends toward the latch 310 at one end thereof.

When the push button 100 is pushed, the pinion 140 rotates, moving the link 150 such that it presses the latch 310. The door of the glovebox 300 is thus released from the instrument panel 400.

Figure 4:
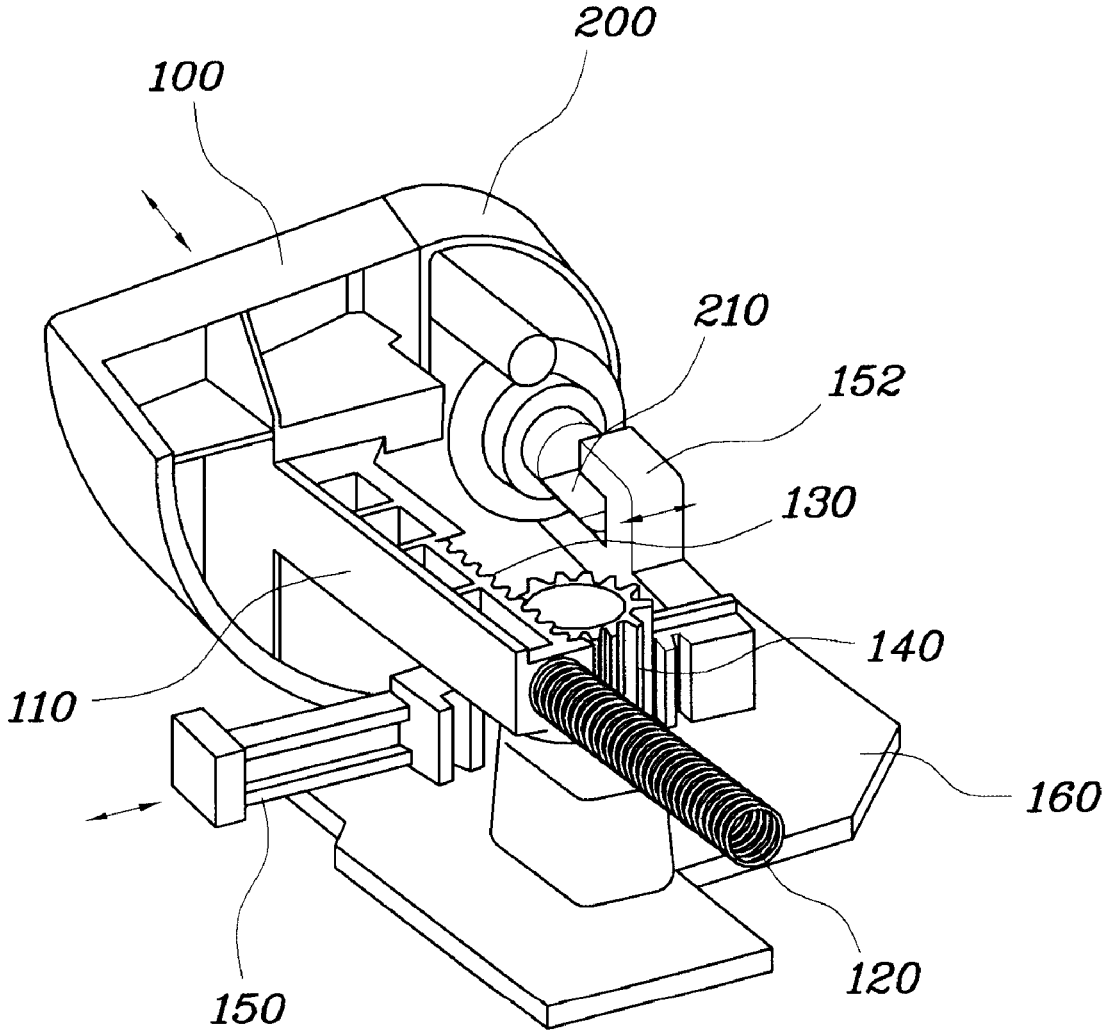
FIG. 4 is a perspective view illustrating the unlocked state of the apparatus of FIG. 2.
Figure 5:
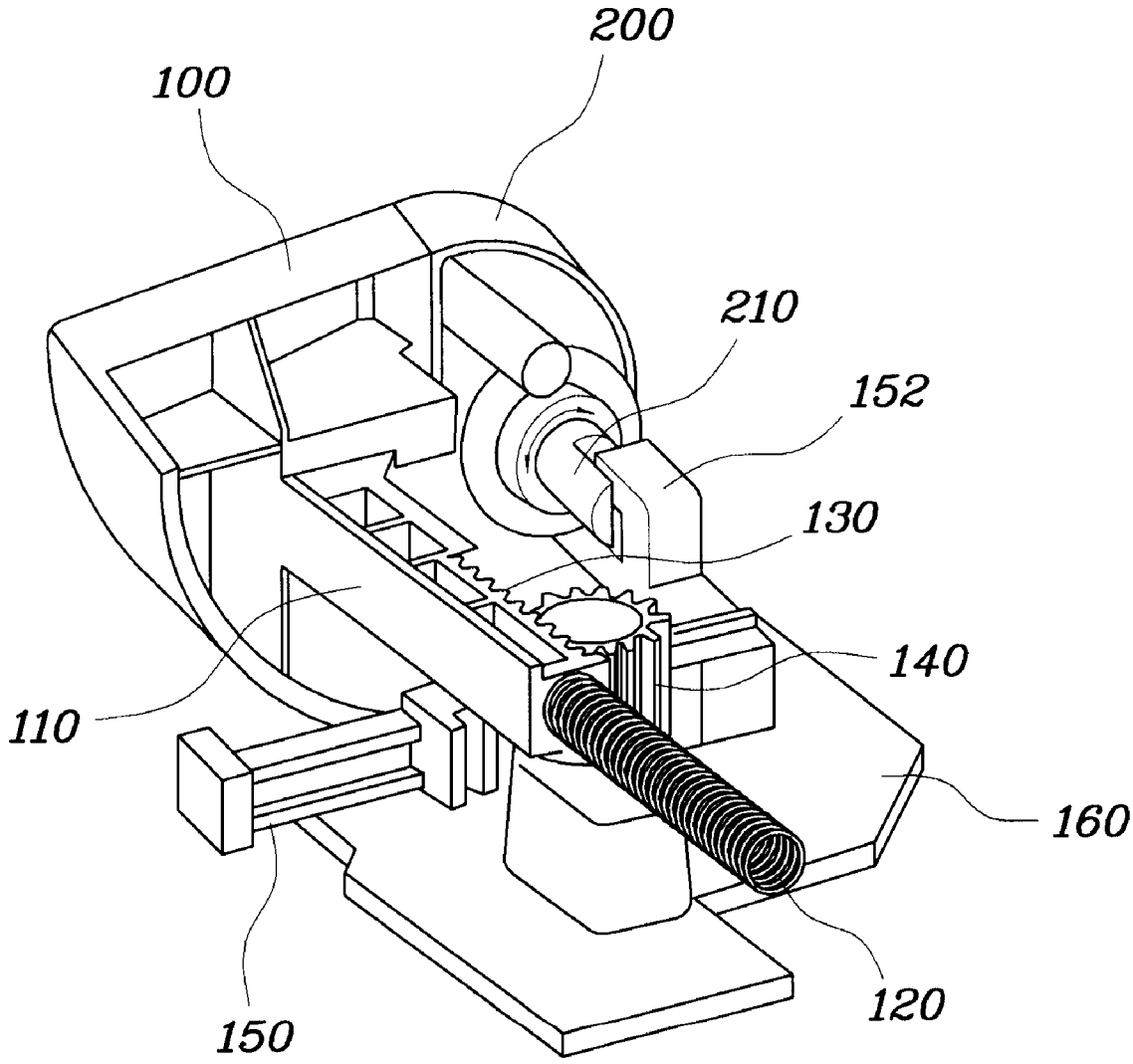
FIG. 5 is a perspective view illustrating the locked state of the apparatus of FIG. 2.

Referring to FIGS. 4 and 5, the instrument panel 400 is further provided with a locking unit 200 for constraining the operation of the push button 100. The locking unit 200 is installed in the instrument panel 400 adjacent to the push button 100, and is provided with a locking plug 210 that interacts with a key. To lock the glovebox 300, the locking plug 210 is rotated, constraining the operation of the link 150.

The locking plug 210 has the shape of a cylinder with a longitudinal notch cut at one end; i.e. its cross-section is semi-circular at one end. Further, the end of the link 150 is provided with a locking rod 152 that abuts the semi-circular end of the locking plug 210.

When the locking plug 210 is rotated to the "lock" position, movement of the locking rod 152 is impeded by the orientation of the locking plug 210, rendering operation of the link 150 impossible even if the push button 100 is pushed.

In the illustrated embodiments described above, the push button 100 and the locking unit 200 are mounted on the instrument panel 400, and the latch 310 is installed on one side of the door of the glovebox 300. However, the present invention is not limited to the above-described structure. For example, the push button 100 and the locking unit 200 may be mounted on the door of the glovebox 300, and the latch 310 may be installed on the instrument panel 400.

Now, the operation of the apparatus according to embodiments of the present invention will be described below with reference to FIG. 3.

When the user pushes the push button 100, the rack bar 130 moves inward (up in FIG. 3). The linear motion of the rack bar 130 is converted into rotational motion of the pinion 140, which is then converted into motion of the link 150. The link 150 pushes the latch 310, which has been constrained by a clamping jaw 410 of the instrument panel 400. Thereby, the door of the glovebox 300 opens away from the instrument panel 400. When the user releases the push button 100, the spring 120 is released, and thus the push button 100 also returns to its original position.

If, however, the glovebox is locked, the operation of the apparatus is as described below with reference to FIG. 4.

The user inserts the key into the locking plug 210 of the locking unit 200, and then turns the key in a locking direction. The locking plug 210 rotates in the locking direction at a predetermined angle, and thereby constrains the locking rod 152 such that operation of the link 150 is impossible. In this state, the operation of the push button 100 is impossible because the locking rod 152 is constrained by the locking plug 210.

As described above, the apparatus for opening and closing the glovebox for the automobile according to the present invention easily and quickly unlocks the door of the glovebox with a rack and pinion, so that the glovebox is reliable, and easy to manufacture.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for opening and closing a glovebox door, the apparatus comprising:

an instrument panel;

a glovebox mounted in the instrument panel, the glovebox comprising a door;

a latch movably mounted to a first one of either the door or the instrument panel between a locked position, at which it abuts a part of a second one of either the door or the instrument panel and constrains relative movement between the door and the instrument panel, and an unlocked position, at which it is unlatched from the part of the second one of either the door or the instrument panel, and allows relative movement between the door and the instrument panel;

a push button mounted to the second one of either the door or the instrument panel;

a rack bar connected to the push button and extending in an inward direction of the instrument panel;

a pinion engaged with the rack bar;

a link having a rack gear engaged with the pinion, the link being movable to lock and unlock the latch; and a locking unit comprising a locking member with open and closed positions and cooperating with the link to directly block movement of the link in the closed position, the locking unit being spaced apart from the push button.

2. The apparatus as set forth in claim 1, wherein the rack bar is biased in an outward direction of the instrument panel.

3. The apparatus as set forth in claim 1, wherein the locking member comprises a locking plug, operable by a key, and the locking unit further comprises a locking rod attached to the link, wherein when the locking plug is in the closed position, the locking plug impedes movement of the locking rod such that the link cannot unlock the latch.

4. The apparatus as set forth in claim 3, wherein an end of the locking plug comprises a substantially semi-circular cross-section, and the locking rod faces the end of the locking plug.

5. The apparatus as set forth in claim 1, wherein the rack bar and the link are substantially perpendicular to each other.

* * * * *